US007464932B2

(12) United States Patent
Darling

(10) Patent No.: US 7,464,932 B2
(45) Date of Patent: Dec. 16, 2008

(54) SHUFFLER DEVICE FOR GAME PIECES

(76) Inventor: Richard Darling, 138 S. Zurich Ave., Egg Harbor City, NJ (US) 08215

( * ) Notice: Subject to any disclaimer, the term of this patent is extended or adjusted under 35 U.S.C. 154(b) by 352 days.

(21) Appl. No.: 11/265,624

(22) Filed: Nov. 2, 2005

(65) Prior Publication Data

US 2007/0096392 A1 May 3, 2007

(51) Int. Cl.
*A63F 1/12* (2006.01)

(52) U.S. Cl. ..... 273/144 A; 273/144 R; 273/149 R

(58) Field of Classification Search ..... 273/142 E, 273/142 F, 142 G, 144 R, 144 A, 144 B, 145 B, 273/145 C, 145 CA, 149 R, 149 P
See application file for complete search history.

(56) References Cited

U.S. PATENT DOCUMENTS 4,586,712 A * 5/1986 Lorber et al. ..... 273/149 R
5,288,075 A 2/1994 Kelley
5,639,089 A * 6/1997 Matsumoto et al. ..... 273/142 E
6,299,167 B1 10/2001 Sines et al.
6,338,678 B1 * 1/2002 Seelig et al. ..... 463/17
6,889,979 B2 5/2005 Blaha et al.

* cited by examiner

*Primary Examiner*—Benjamin H Layno
(74) *Attorney, Agent, or Firm*—Mathews, Shepherd, McKay & Bruneau, P.A.

(57) ABSTRACT

The present invention relates to a shuffler device including a tub for receiving one or more game pieces. The game pieces can be, for example, revealer devices, cards, and dice or Mah Jongg tiles. The bottom of the tub includes a plurality of raised portions. Alternatively, the bottom of the tub can include a plurality of ball bearings. The tub is rotated and one or more game pieces can be removed from the tub. In an alternate embodiment, a slidable door is formed in the tub for receiving the revealer device or game pieces. The slidable door can be attached to a covered chute. In one embodiment, two connected tubs are used to each receive a set of revealer devices or game pieces.

14 Claims, 18 Drawing Sheets

SHUFFLER DEVICE FOR GAME PIECES

BACKGROUND OF THE INVENTION

1. Field of the Invention

This invention relates to a device for a game in which game pieces are randomly shuffled.

2. Description of Related Art

Conventional card shuffling devices are known. U.S. Pat. No. 6,299,167 describes a playing card shuffler for shuffling a stack of playing cards with random distribution. An infeed playing card stack holder supports an unshuffled playing card stack and discharges playing cards from incremental positions of the unshuffled playing card stack to a shuffled card receiver.

U.S. Pat. No. 6,889,979 disclose a card shuffler with a drivable shuffling storage means which is provided with compartments for receiving cards and which is associated with an input apparatus for inserting cards into the compartments one by one and an output storage means which is spaced from the same for the shuffled cards, with the drive of the shuffling storage means, the input apparatus and the output storage means being controlled by an electronic control system. The card shuffler is capable of continually displaying the number of playing cards situated in the card shuffler and thus of providing the operator with the opportunity to have at all times certainty about the complete number of playing cards by an input apparatus being provided with a draw-in zone whose height corresponds substantially to the thickness of a card and a first detection means and a second detection means is provided which detects the cards inserted into and removed from the shuffling storage means.

It is desirable to provide a simple device for randomly shuffling game pieces or cards.

SUMMARY OF THE INVENTION

The present invention relates to a shuffler device including a tub for receiving one or more game pieces. The game pieces can be, for example, revealer devices, cards, and dice or Mah Jongg tiles. The bottom of the tub includes a plurality of raised portions. Alternatively, the bottom of the tub can include a plurality of ball bearings. The tub is rotated and one or more game pieces can be removed from the tub.

In an alternate embodiment, a slidable door is formed in the tub for receiving the game pieces. The slidable door can be attached to a covered chute. In one embodiment, two connected tubs are used to each receive a set of game pieces or revealer devices.

In an alternate embodiment, a housing includes a plurality of slots for receiving revealer devices or game pieces. An activation means randomly activates on of the slots for receiving a revealer device or game piece. The received revealer device or game piece can be received in a door. A chute can be coupled to the door for receiving the revealer device or game pieces from the housing.

The invention will be more fully described by reference to the following drawings.

DETAILED DESCRIPTION

Figure 1:
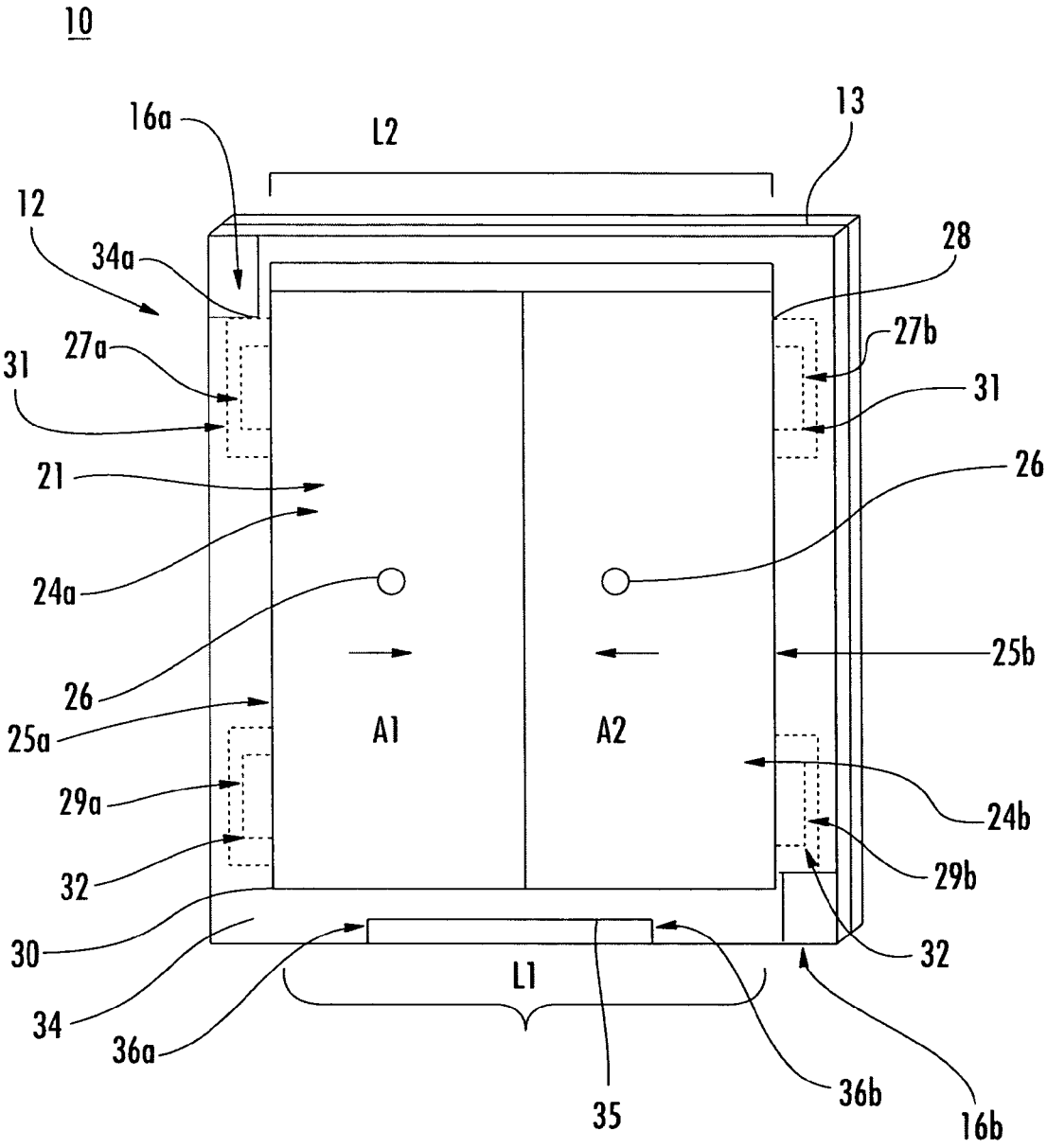
FIG. 1 is a schematic diagram of a game piece of a revealer device in accordance with the teachings of the game of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic diagram of a game piece comprising revealer device 10 for gradually revealing values of a game piece in accordance with the teachings of the present invention. A revealer device is described in U.S. patent application Ser. No. 11/190,294, the entire contents of which are hereby incorporated into this application. Housing 12 includes slot 13 for receiving game piece 14. Housing 12 can have a thickness which is slightly thicker than game piece 12. For example, housing 12 can have a thickness in the range of about 0.05 inches to about 0.25 inches. In one embodiment, one or more conventional decks of 52 cards can be used as game pieces. In an alternate embodiment, an Ace is used in addition to the numeric cards 2 through 10. In an alternate embodiment, only numeric cards 2 through 10 are used as game pieces. In an alternate embodiment, Mah Jongg tiles can be used as game pieces. A number of Mah Jongg tiles are dealt to a player. Each of the Mah Jongg tiles is assigned the same point value as the values on the face of the Mah Jongg tiles.

Housing 12 can have a shape matching game piece 14. For example, housing 12 can be rectangular, square, round or oval. Alternatively, housing 12 can have a shape which is different from game piece 14. Housing 12 can include opaque corners 16*a* and 16*b*. Opaque corners 16*a* and 16*b* are used to cover respective corners 15*a* and 15*b* of game piece 14, such as a conventional card. Corners 15*a* and l5*b* of game piece 14 typically include a representation of the value of the card 17 and a representation of a suit 18.

For example, game pieces 14 can be a conventional deck of cards or ten cards or subset thereof, such as an ace, two, three, four, five, six, seven, eight, nine or ten. Each game piece 14 can have a representative of a suit 18 located in one or more of outer columns 19*a*, 19*c* or inner column 19*b* of game piece 14. Alternatively, game piece 14 can include other types of markings located in one or more outer columns 19*a*-19*c* or inner column 19*b*.

Housing 12 includes opaque center section 21. Opaque center section 21 covers center section 22 of game piece 14 for covering all representatives of a suit 18 of game piece 14. Opaque center section 21 can include a pair of movable doors 24*a*, 24*b*. Movable doors 24*a*, 24*b* can be retained within tracks 25*a* and 25*b*. For example, the distance between track 25*a* and track 25*b* has a length $L_1$ which is the same as the length $L_2$ of opaque center section 21.

Figure 2:
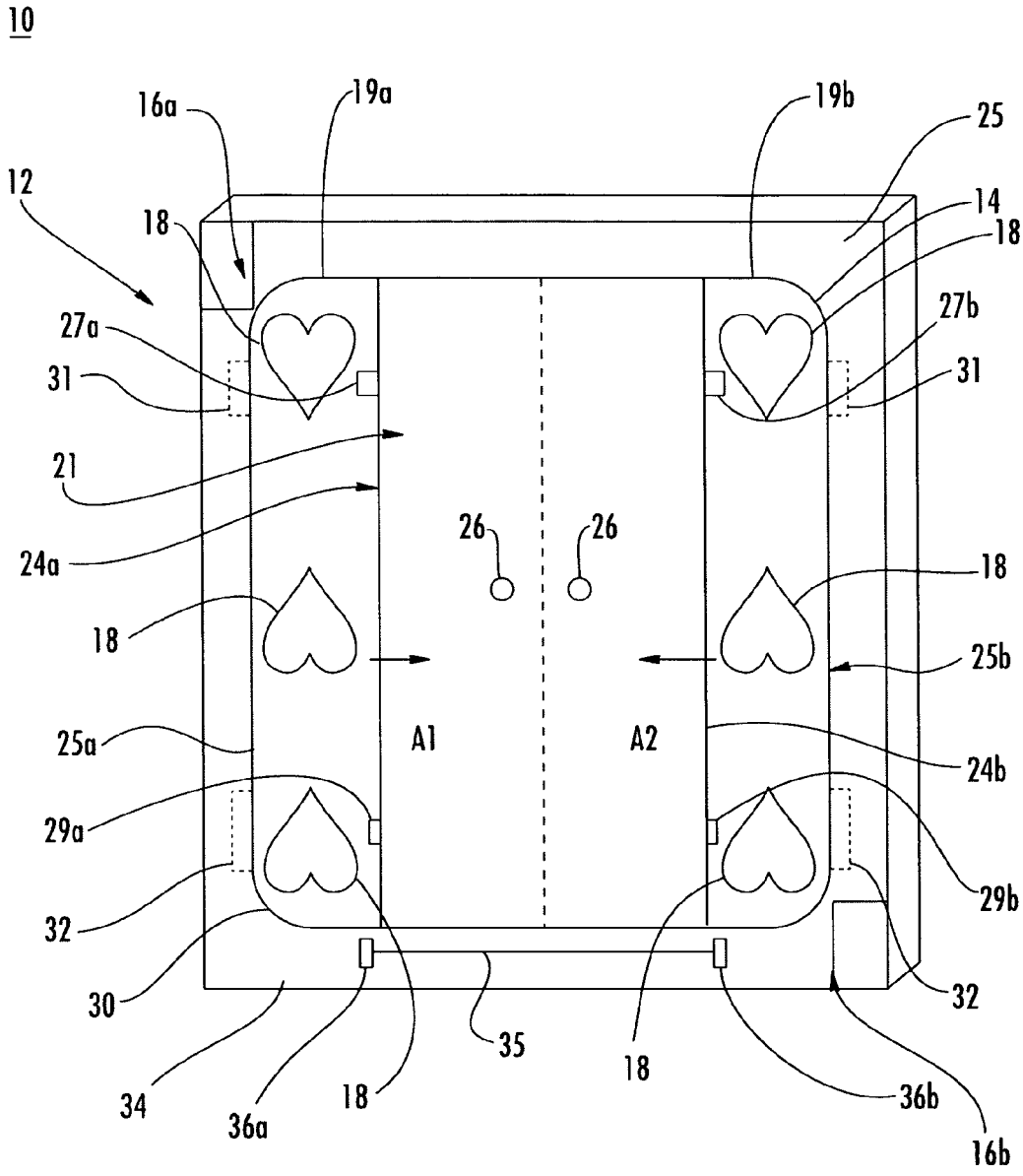
FIG. 2 is a schematic diagram of the revealer device upon movement of movable doors in a horizontal direction.

Protrusion 26 can extend from movable doors 24*a*, 24*b*. Protrusion 26 can be pressed against by a user's finger for moving movable doors 24*a*, 24*b* towards one another in a lateral direction of arrows $A_1$ and $A_2$. Upon moving of movable doors 24*a*, 24*b* toward one another, one of movable doors 24*a*, 24*b* can slide under the other one of movable doors 24*a*, 24*b* and outer columns 19*a* and 19*c* of game piece 14 are revealed, as shown in FIG. 2.

Housing 12 includes pins 27*a*, 27*b* adjacent top portion 28 of movable doors 24*a*, 24*b* and pins 29*a*, 29*b* adjacent bottom portion 30 of movable doors 24*a*, 24*b*. Pins 27*a*, 27*b* are received in slot 31 of housing 12. Pins 29*a*, 29*b* are received in slot 32 of housing 12. Pins 27*a*, 27*b* and pins 29*a*, 29*b* retain movable doors 24*a*, 24*b* in the closed position.

Figure 3:
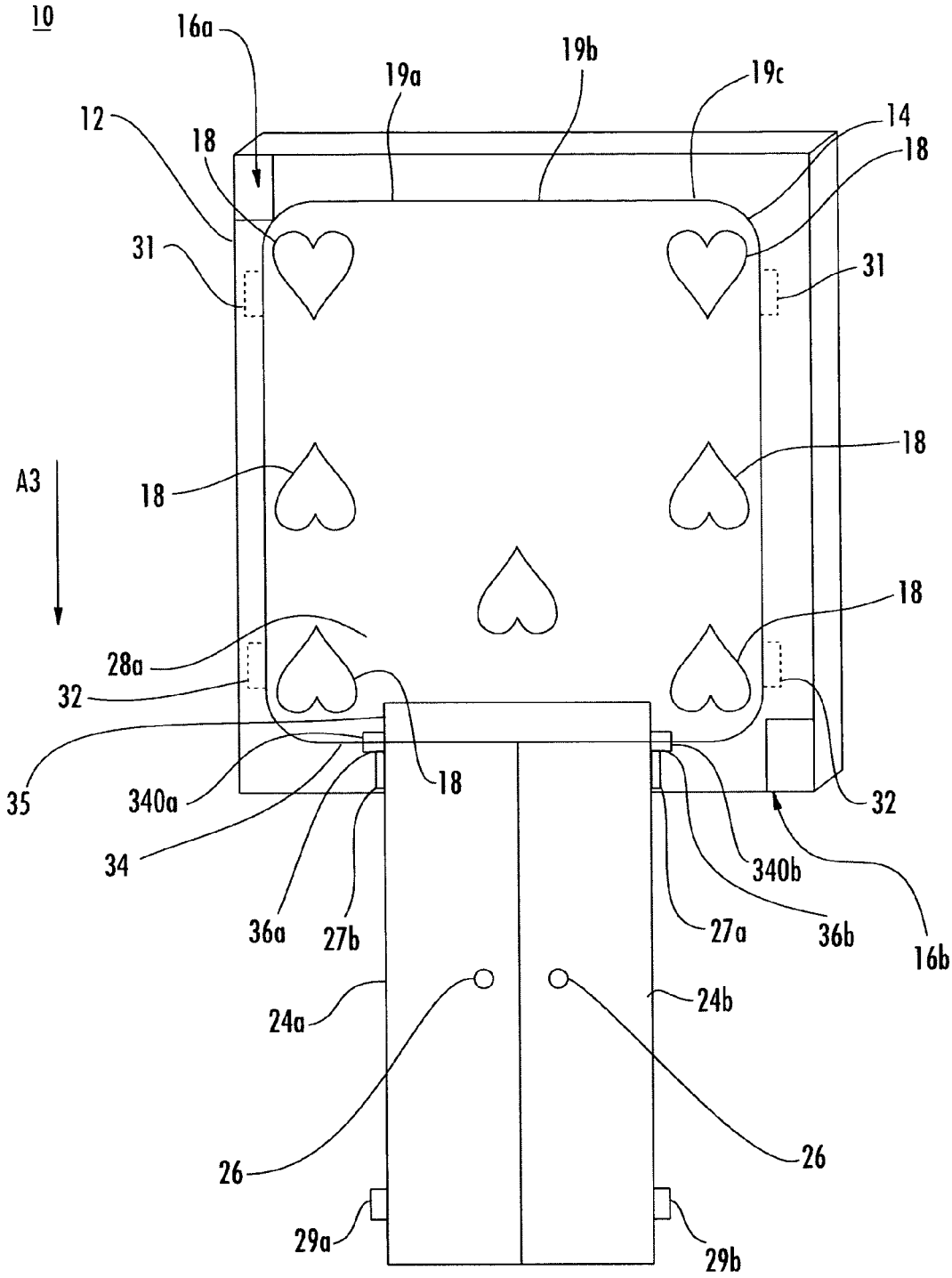
FIG. 3 is a schematic diagram of the revealer device upon movement of movable doors in a vertical direction.

Referring to FIG. 3, during playing of a game, upon movement of movable doors 24*a*, 24*b* toward one another in the lateral direction, pins 27*a*, 27*b* and pins 29*a*, 29*b* are released from respective slots 31 and 32 to allow movable doors 24*a*, 24*b* to slide in a vertical direction of arrow $A_3$ for gradually revealing representatives of a suit 18 located in inner column 19*b* of game piece 14. Movable doors 24*a*, 24*b* can slide vertically within track 35 positioned at bottom 34 of housing 12. Stops 340*a*, 340*b* are positioned at top portion of movable doors 24*a*, 24*b*. Upon movement of movable doors 24*a*, 24*b* in the vertical direction to bottom 34 of housing 12, stops 340*a*, 340*b* contact edge 36*a*, 36*b* of track 35 to prevent movable doors 24*a*, 24*b* from being removed from housing 12.

Figure 4:
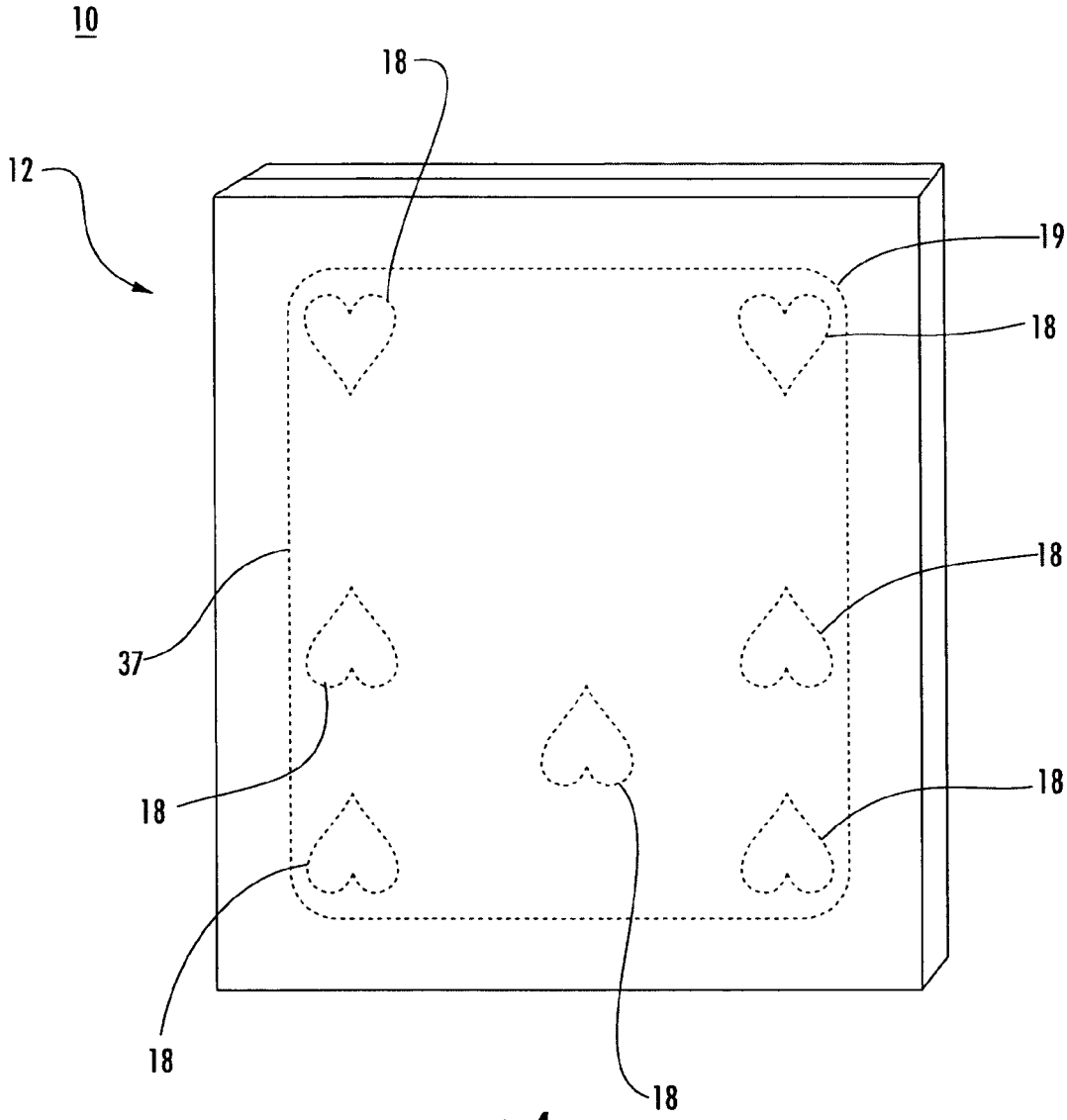
FIG. 4 is a schematic diagram of a rear of the revealer device.

In one embodiment, a pair of game pieces 14 having the same value can be received in slot 13. Game pieces 14 are placed back to back to show representatives of a suit 18 on either side of revealer device 10, as shown in FIG. 4. Rear housing 37 is transparent for showing the value of the one of game pieces 18 through rear housing 37. Accordingly, if a player does not want to. gradually reveal game piece 14, the user can flip over revealer device 10 for revealing game piece 14.

Figure 5:
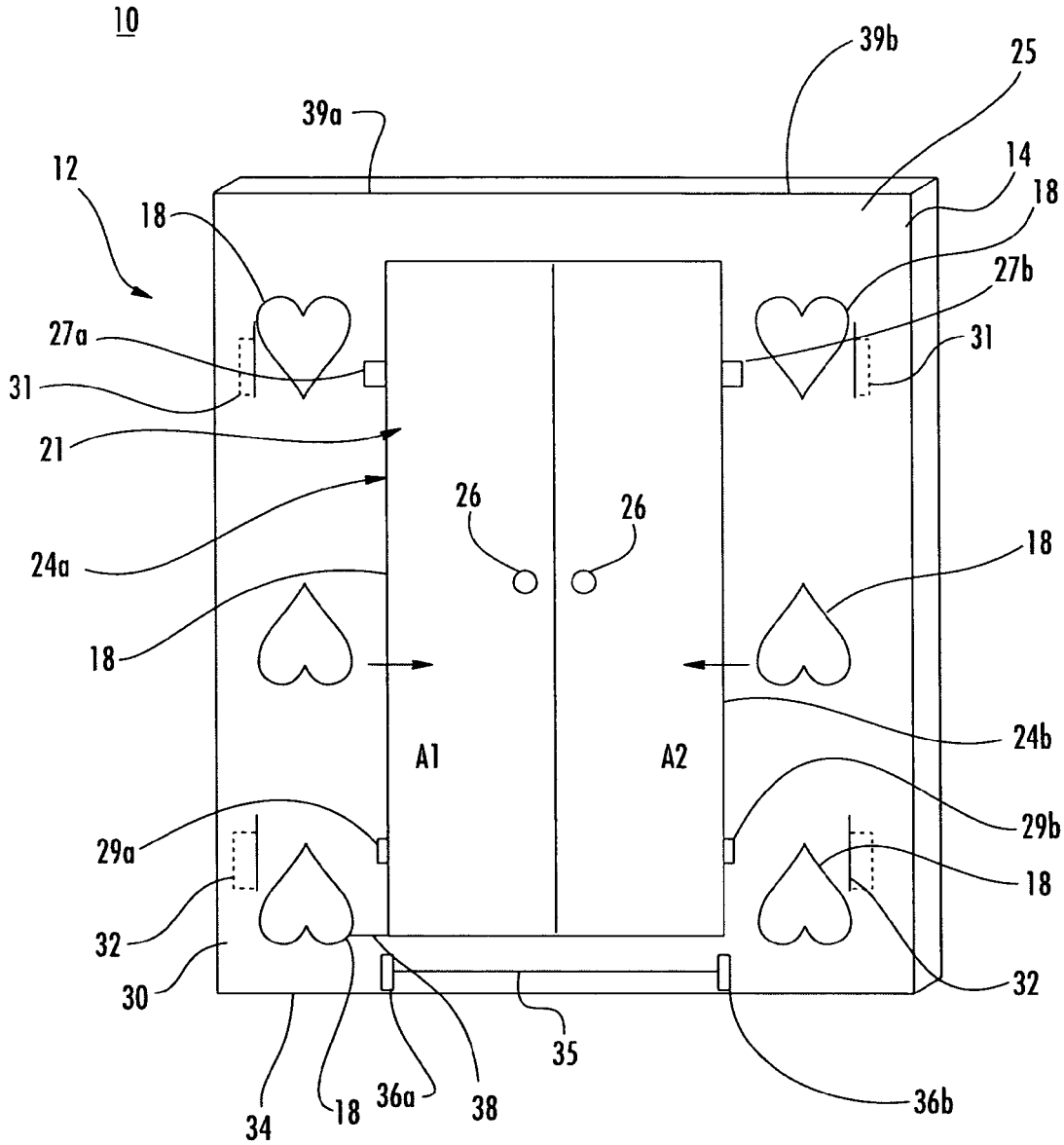
FIG. 5 is a schematic diagram of an alternate embodiment of the revealer device upon movement of movable doors in a horizontal direction.
Figure 6:
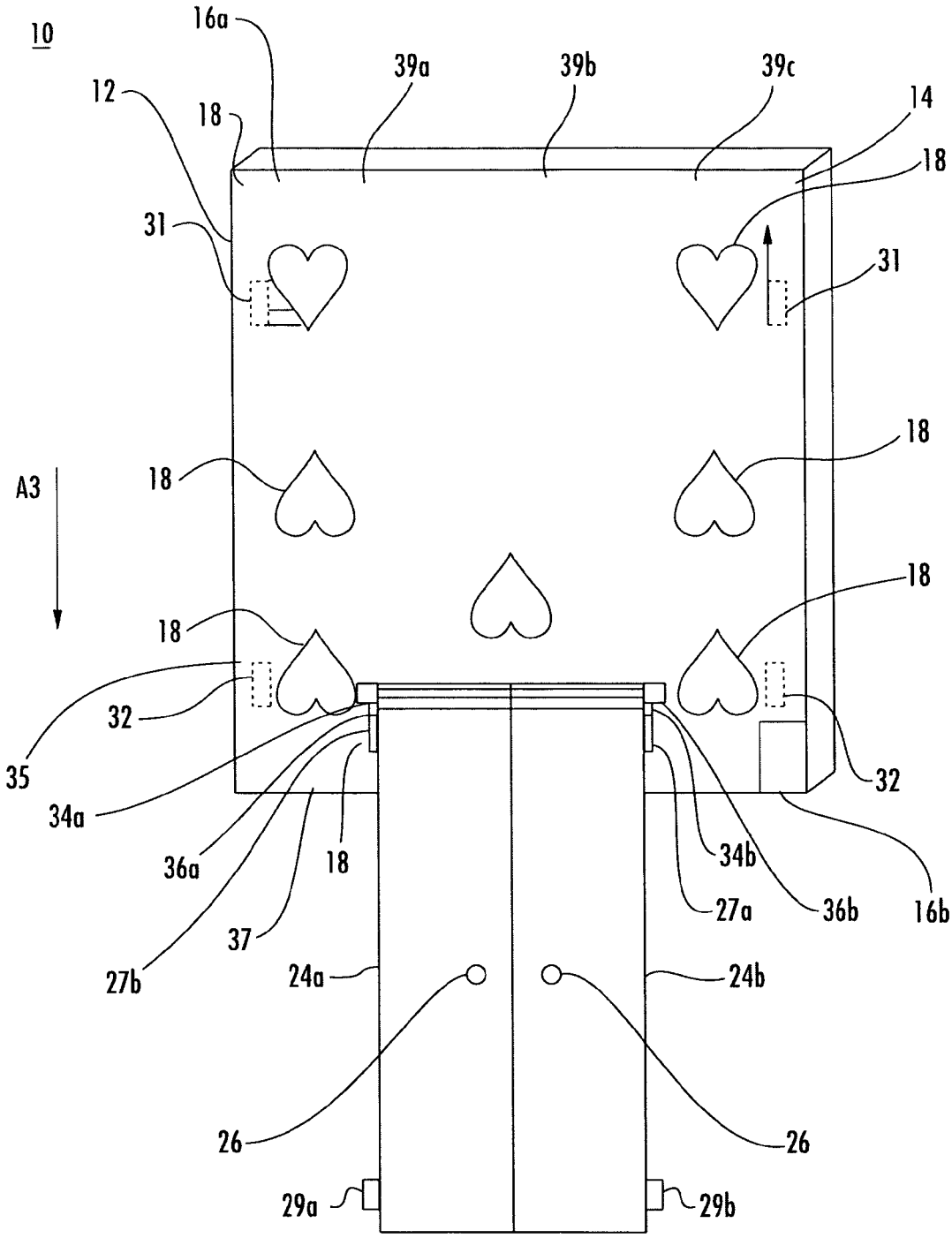
FIG. 6 is a schematic diagram of an alternate embodiment of the revealer device upon movement of movable doors in a vertical direction.
Figure 7:
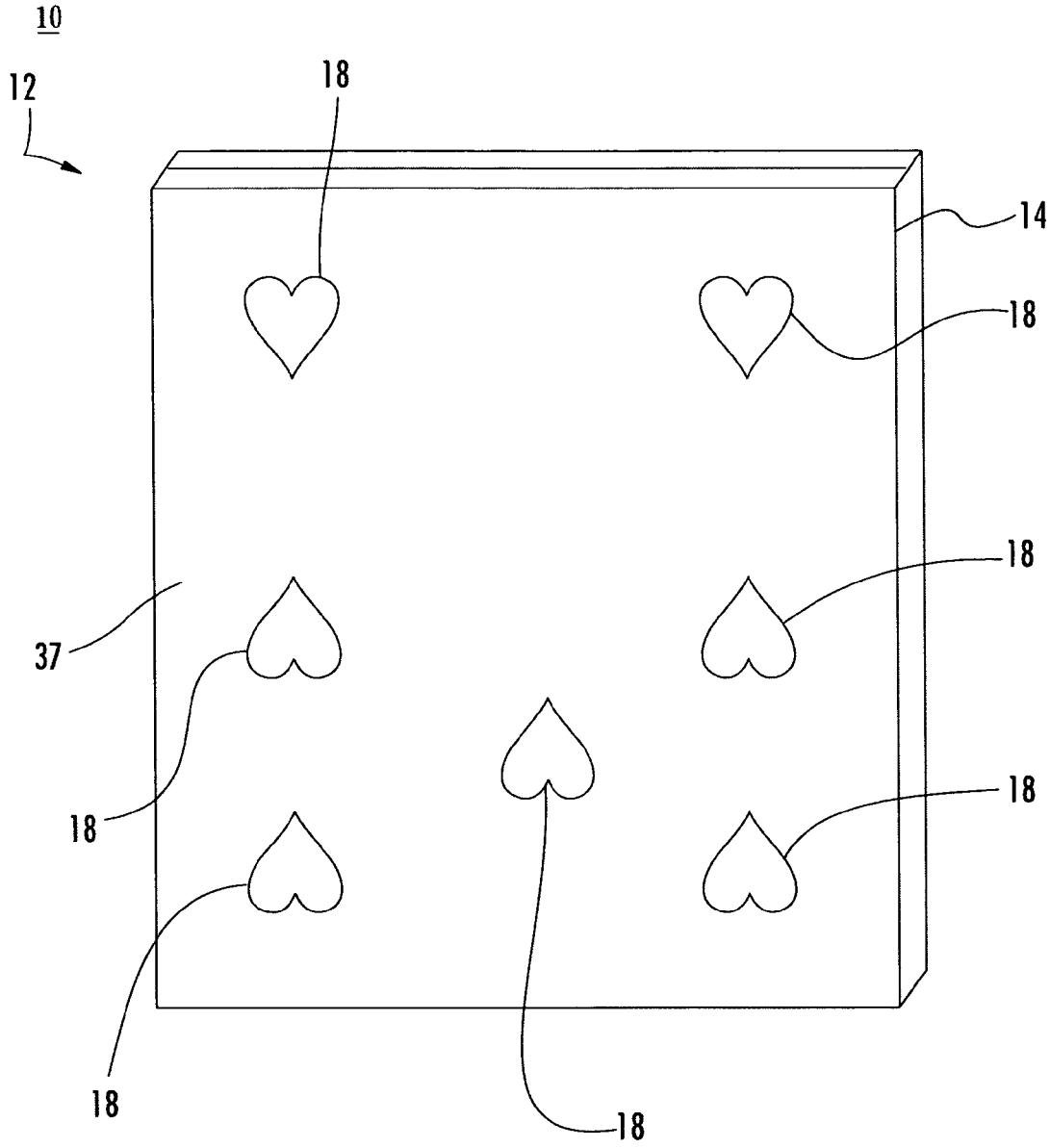
FIG. 7 is a schematic diagram of a rear of the revealer device shown in FIG. 5.
Figure 8:
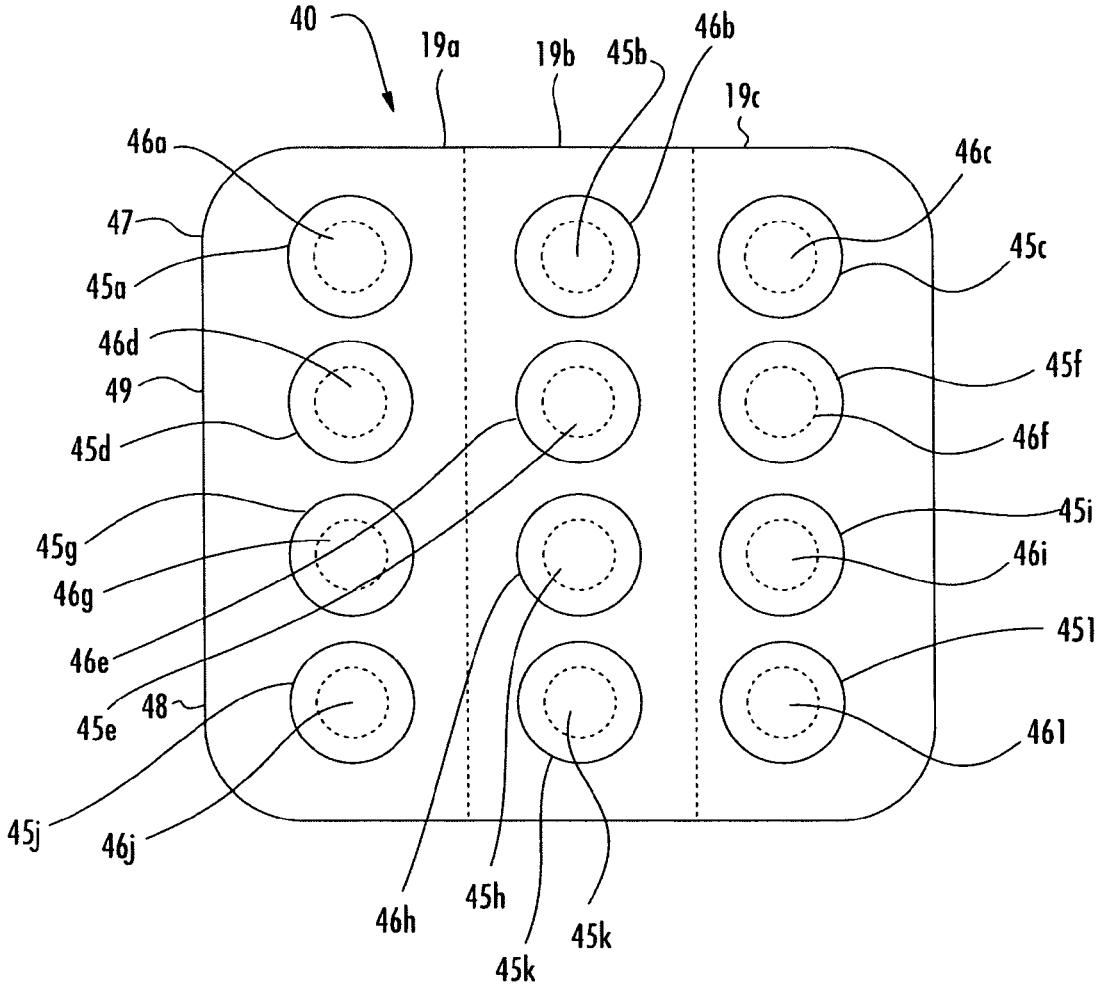
FIG. 8 is a schematic diagram of an alternate embodiment of a revealer device.

In an alternate embodiment, representative of a suit 18 or markings related to game piece 14 are marked on inner housing 38. For example, representatives of a suit 18 can be imprinted or stamped on inner housing 38 in columns 39*a*-39*c*, as shown in FIGS. 5-6. In this embodiment, game piece 14 is not received in housing 12. Upon moving of movable doors 24*a*, 24*b* toward one another, one of movable doors 24*a*, 24*b* slides under the other one of movable doors 24*a*, 24*b* and outer columns 39*a*-39*c* of inner housing 38 are revealed as shown in FIG. 5. Movable doors 24*a*, 24*b* can slide vertically within track 35 positioned at bottom 34 of housing 12 for gradually revealing representatives of a suit 18 located in inner column 39*b* of inner housing 38 as shown in FIG. 7. The same representatives of a suit 18 which are coupled to inner housing 38 can be coupled to rear housing 37 as shown in FIG. 8. In an alternate embodiment, revealed device includes representative of a suit 18 integral with rear housing 37.

In an alternate embodiment, revealer device 40 can be used with game pieces 14 as shown in FIG. 8. For example, game pieces 14 can be cards 2 through 10 and an Ace. During playing of a game, game piece 14 slides into or is placed under revealer device 40. For example, a dealer can slide game piece 14 into revealer device 40 or place game piece 14 under revealer device 40.

Revealer device 40 can include one or more of opaque portions 45*a*-*l* positioned relative to columns 19*a*-19*c* to cover the representation of a suit or markings of game piece 18. Referring to FIG. 8, opaque portions 45*a*-*l* can be individually rotated or slid to reveal transparent portions 46*a*-*l* positioned respectively directed beneath opaque portions 45*a*-*l*. Upon revealing of each transparent portion 46, the corresponding representative of a suit 18 or marking underneath each transparent portion 46 is shown. The number of opaque portions 45*a*-*l* corresponds to the highest number of representative of a suit 18 or markings on the game piece. For example, there can be ten opaque portions 45 to cover ten representative markings of a suit on a game piece having a value of ten. In one embodiment, revealer device 40 can be formed of plastic including opaque plastic discs to form opaque portions 45 which are hinged to transparent plastic portions to form transparent portions 46.

The selection of the order for revealing opaque portions 45*a*-*l* can be selected by the player or can be a predetermined order. For example, during play, if opaque portion 45*a* is selected, revealing of transparent portion 46*a* shows whether or not a representative of a suit 18 is shown in column 19*a* underneath transparent portion 46*a* at upper portion 47 of game piece 14.

Figure 9A:
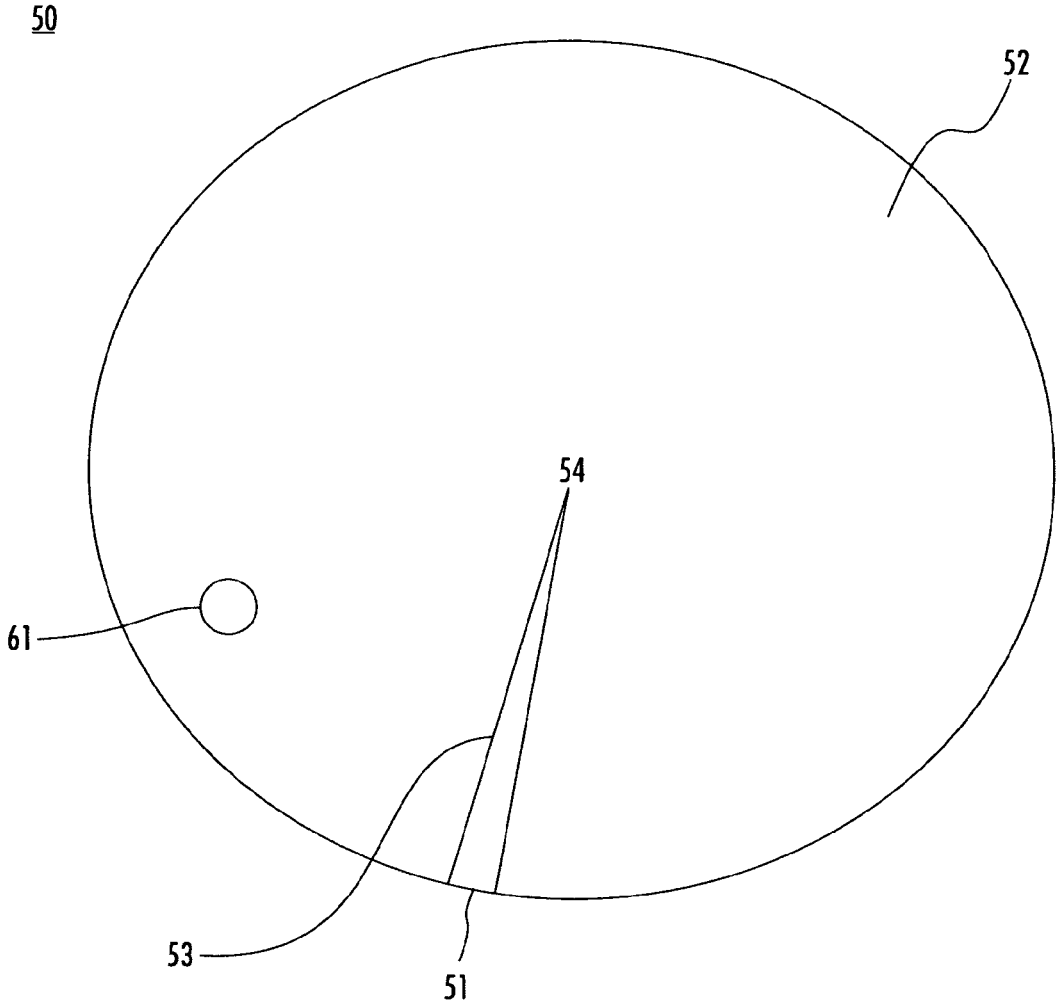
FIG. 9A is a schematic diagram of an alternate embodiment of a revealer device.
Figure 9B:
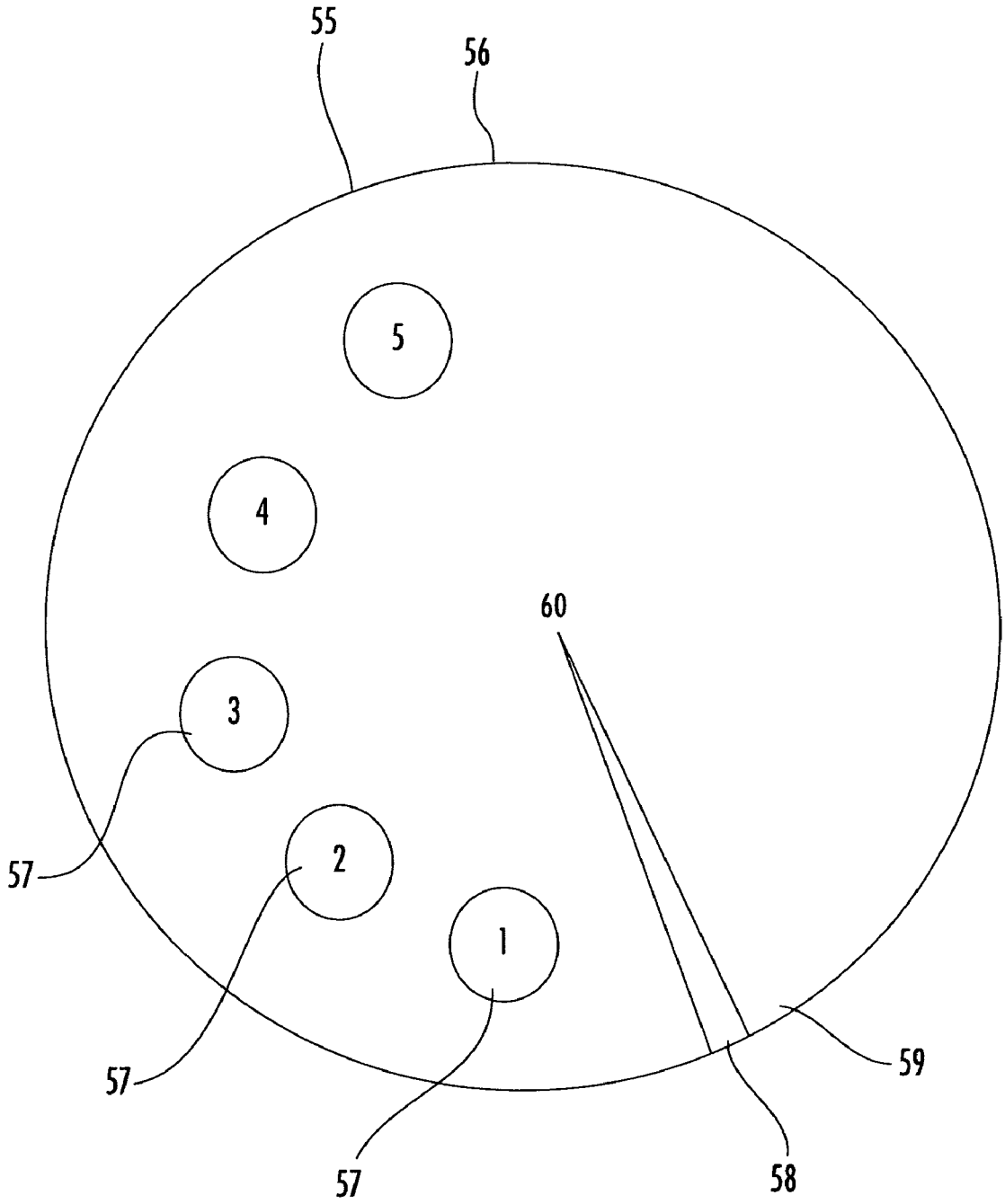
FIG. 9B is a schematic diagram of a game piece which can be used with the revealer device of FIG. 9A.
Figure 9C:
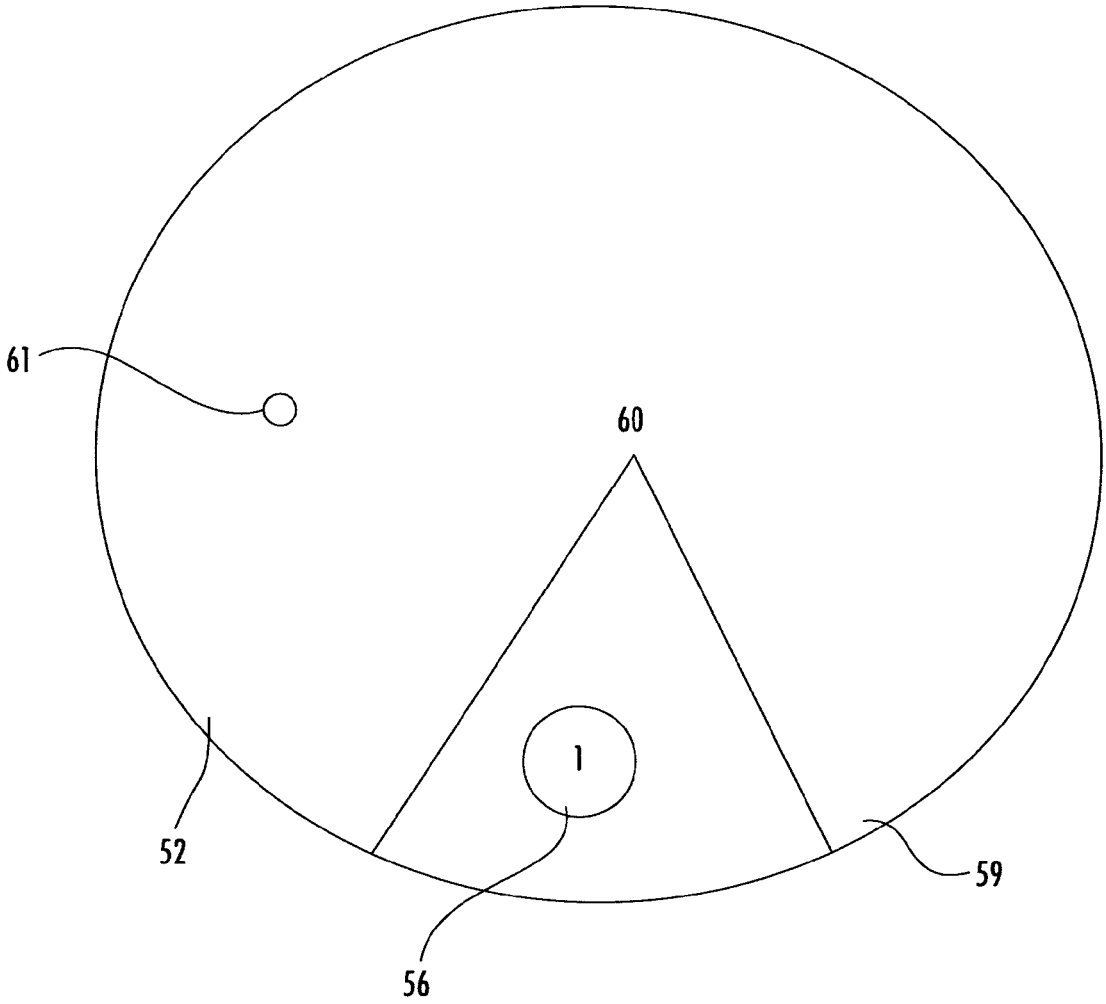
FIG. 9C is a schematic diagram of the revealer device and game piece during play.

In an alternate embodiment, revealer device 50 comprises circular housing 52 as shown in FIG. 9A. Circular housing 52 includes slot 53. Slot 53 extends radially from edge 51 to center 54 of circular housing 52. Circular game piece 55 comprises circular body 56, as shown in FIG. 9B. Values 57 are formed on circular game piece 55. Circular game piece 55 includes slot 58. Slot 58 extends radially from edge 59 to center 60 of circular game piece 55. During playing, slot 53 of circular housing 52 is received in slot 58 of circular game piece 55 such that circular housing 52 covers circular game piece 55. Circular housing 52 is rotated to gradually uncover values 57 of circular game piece 55, as shown in FIG. 9C. Indentation 61 can be formed in circular housing 52 for receiving a digit or thumb to push against circular housing 52 for rotation of circular housing 52 over circular game piece 55.

For example, circular housing 52 and circular game piece 55 can be formed of plastic, cardboard, laminated cardboard or paper, such as a material used in a conventional card.

Figure 10A:
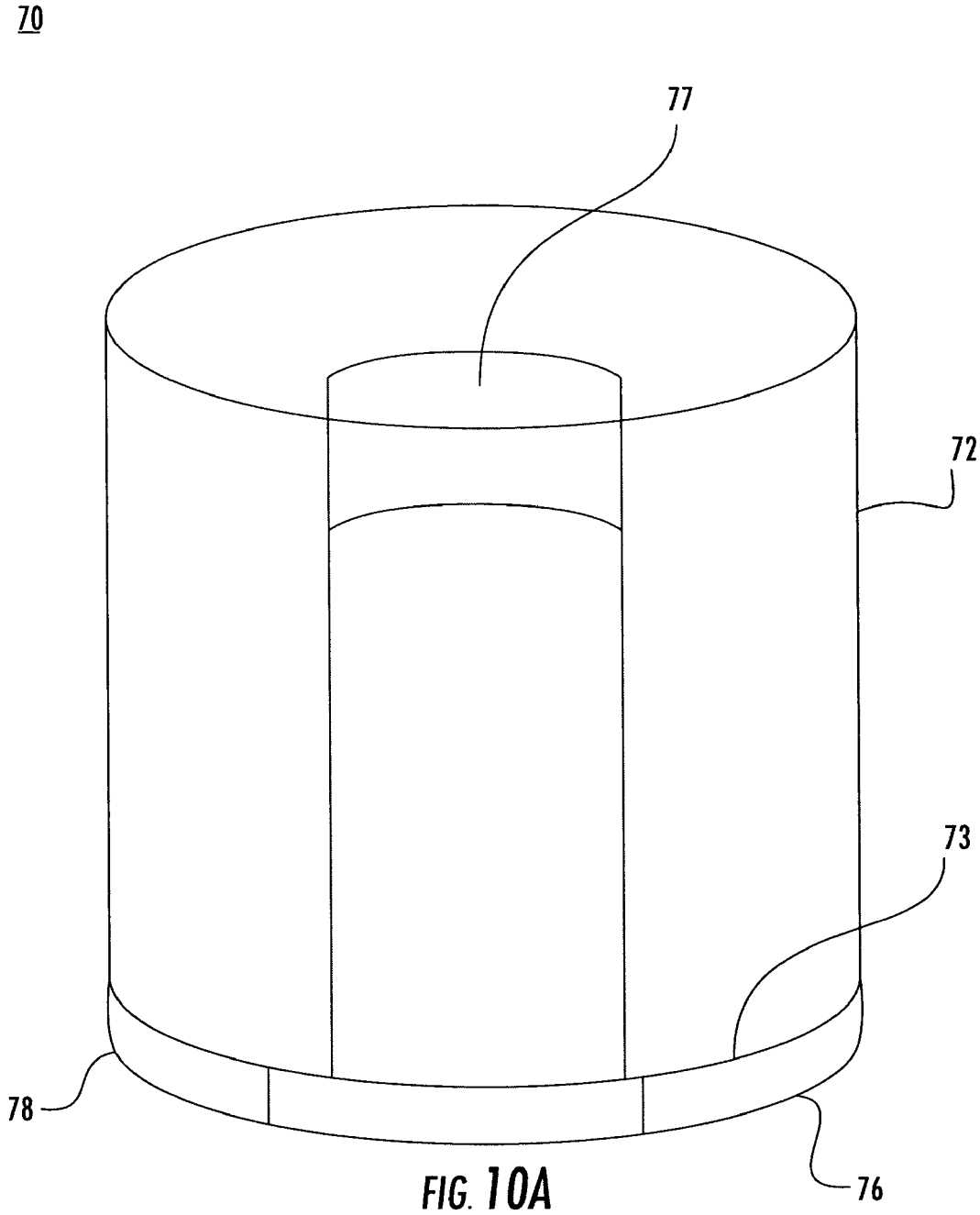
FIG. 10A is a perspective side and inner view of a shuffler device which can be used for shuffling game pieces.
Figure 10B:
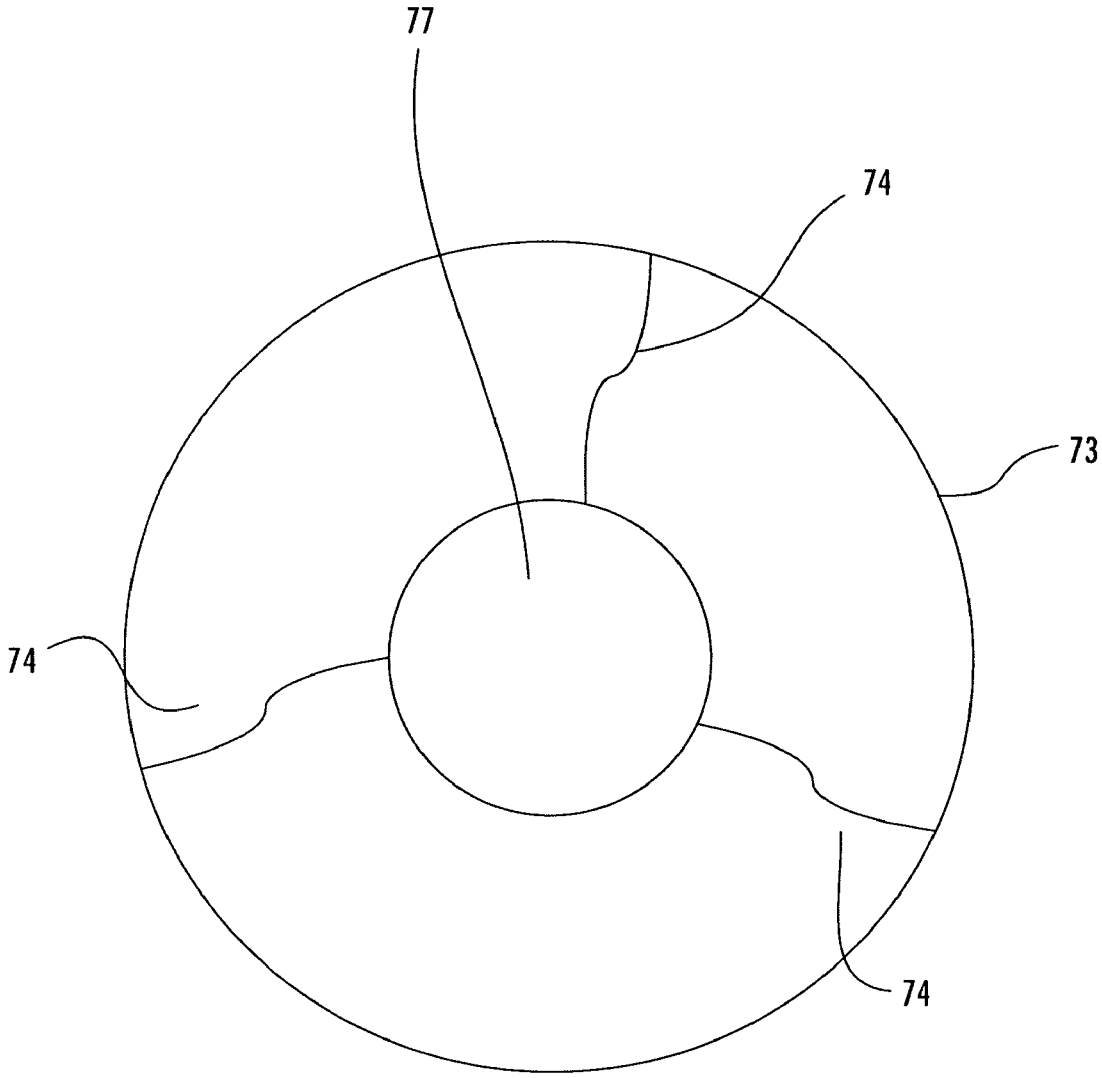
FIG. 10B is a top plan view of the shuffler device shown in FIG. 10A.

FIGS. 10A-10B are schematic diagrams of shuffler device 70 which can be used for shuffling revealer device 10, 40 or 50. Alternatively, game pieces 71 can be shuffled with shuffler device 70. Game pieces 71 can be a playing card. Game pieces 71 can be formed of a material to provide stability. Shuffler device 70 comprises tub 72 for receiving revealer device 10, 40 or 50 or game pieces 71. Bottom portion 73 of tub 72 comprises a plurality of raised portions 74. In one embodiment, tub 72 has a height of less than a diameter of revealer device 10, 40 or 50 or game pieces 71 for preventing revealer device 10, 40 or 50 or game pieces 71 from flipping over. Tub 72 can be closed by cover 75. During operation tub 72 is rotated with rotation means 76, such as a motor. Rotation means 76 rotates agitator 77. Revealer device 10, 40 or 50 or game pieces 71 contacts raised portions 74 for shuffling revealer device 10, 40 or 50 or game pieces 71 within tub 72. Raised portions 74 can be raised or lowered with means 78 for altering the number of raised portions 74 used in shuffler device 70.

Figure 10C:
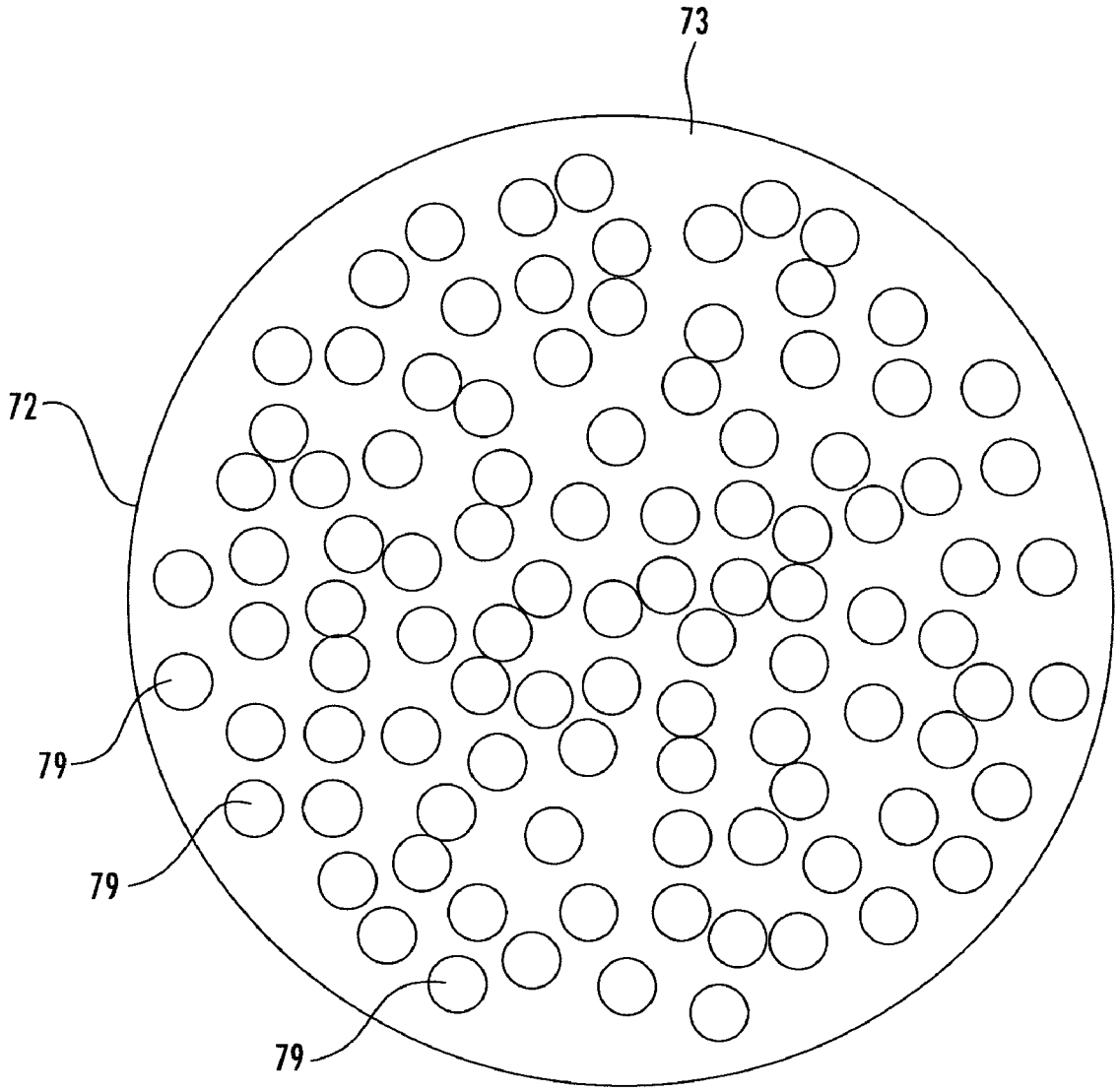
FIG. 10C is a top plan view of an alternate embodiment of the shuffler device.

In an alternate embodiment, bottom portion 73 of tub 72 comprises a plurality of ball bearings 79, as shown in FIG. 10C. During operation tub 72 is rotated with rotation means 76, such as a motor. Revealer device 10, 40 or 50 or game pieces 71 contacts ball bearings 79 for shuffling revealer device 10, 40 or 50 or game pieces 71 within tub 72. After shuffling, revealer device 10, 40 or 50 or game pieces 71 can be manually removed from tub 72.

Figure 11:
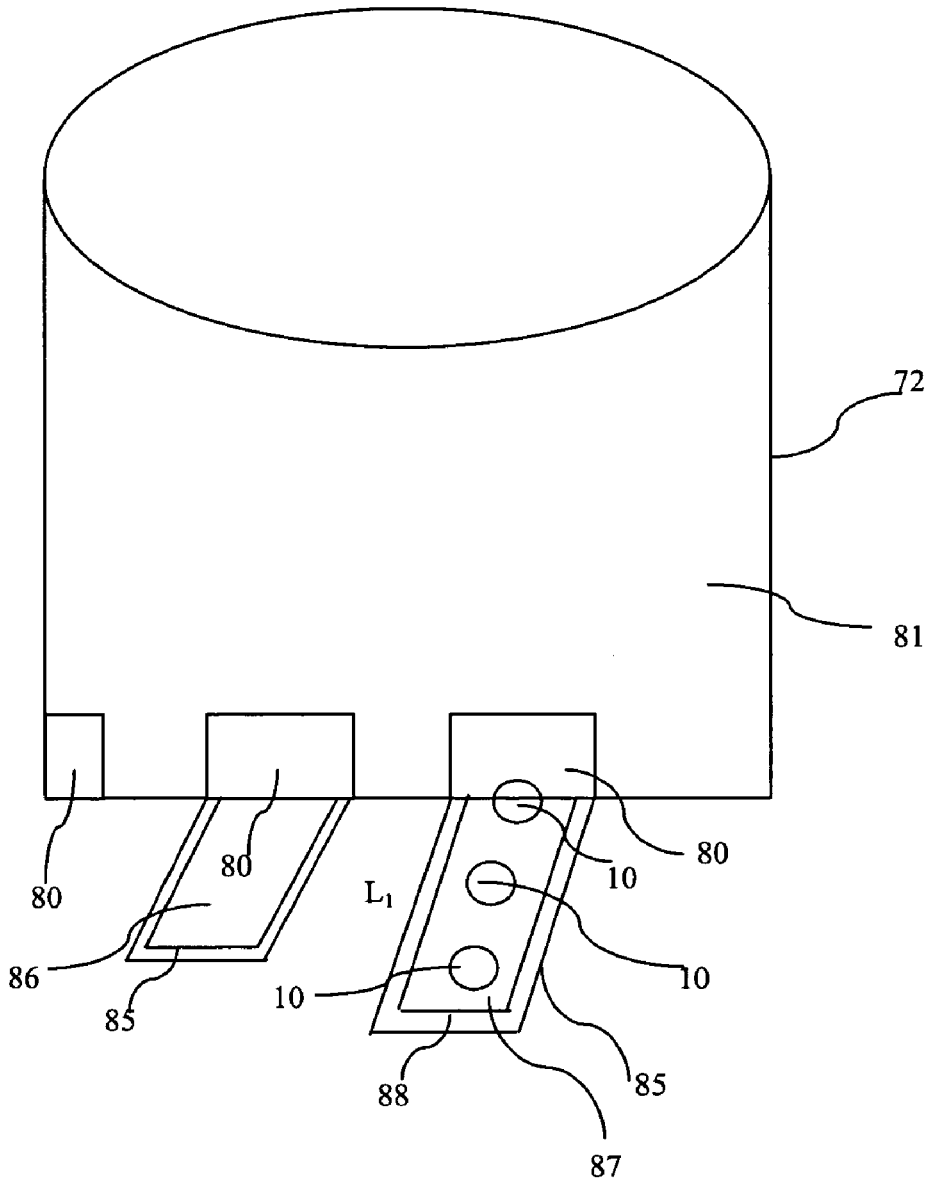
FIG. 11 is a schematic diagram of an alternate embodiment of the shuffler device.

In an alternate embodiment, one or more doors 80 are formed in side 81 of tub 72, as shown in FIG. 11. Doors 80 slide open for removing one or more of revealer device 10, 40 or 50 or game pieces 71 from tub 72. In one embodiment, chute 85 is coupled to at least one of one or more of doors 80. Chute 85 receives one or more revealer device 10, 40 or 50 or game pieces 71 along length $L_1$ of chute 85. For example, chute 85 can receive up to three of revealer devices 10, 40 or 50 or game pieces 71. Cover 86 can be coupled to chute 85 for hiding revealer device 10, 40 or 50 or game pieces 71 received in chute 85. Sensing means 87 can be associated with chute 85 to provide an indication of the number of revealer devices 10, 40 or 50 or game pieces 71 which have been received in chute 85. In one embodiment, retaining means 88 prevents revealer device 10, 40 or 50 or game pieces 71 from being removed from chute 85 until physically removed, such as by a dealer. For example, retaining means 88 can be a spring.

Figure 12:
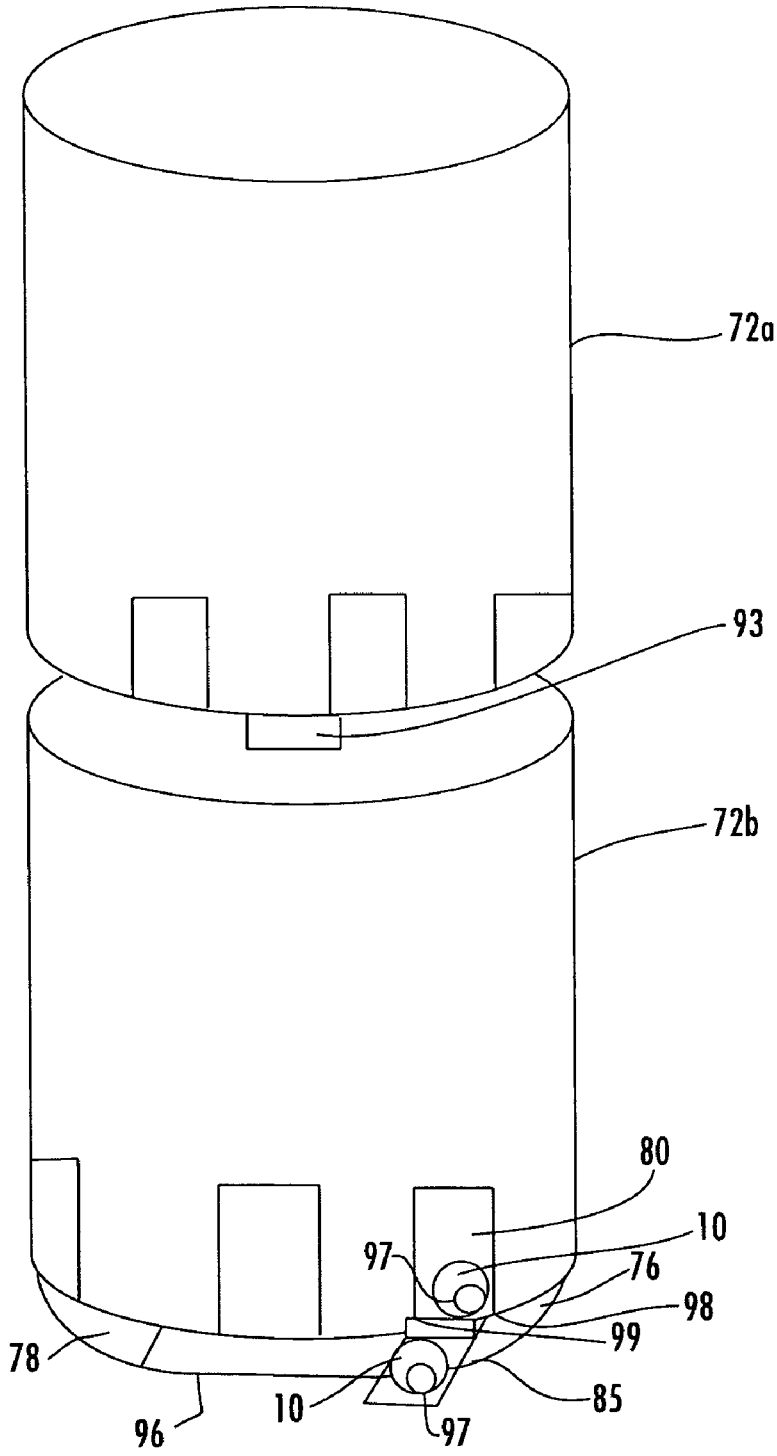
FIG. 12 is a schematic diagram of an alternate embodiment of the shuffler device.

In one embodiment, shuffler device 100 comprises two tubs 72*a*, 72*b*, as shown in FIG. 12. Tub 72*a* can be attached to tub 72*b* with attachment 93. Each tub receives a set of revealer devices 10, 40 or 50 or game pieces 71. For example, the set of revealer devices 10, 40 or 50 or game pieces 71 can correspond to a conventional deck of cards. Revealer devices 10, 40 or 50 or game pieces 71 in tub 72*a* can have a different color than revealer devices 10, 40 or 50 or game pieces 71 in tub 72*b*. During play, revealer devices 10, 40 or 50 or game pieces 71 can be removed first from tub 72*a* and later from tub 72*b* to provide continuous shuffling. During operation, tub 72*a* and tub 72*b* are rotated with rotation means 76, such as a motor.

In one embodiment, magnet 97 is attached to revealer device 10, 40 or 50 or game pieces 71. Magnet 98 coupled to tub 72 attracts magnet 97 of one of revealer devices 10, 40 or 50 or game pieces 71. Arm 99 releases magnet 97 at revealer device 10, 40 or 50 or game piece 71 from magnet 98 and allows revealer device 10, 40 or 50 or game pieces 71 to enter chute 85.

Figure 13A:
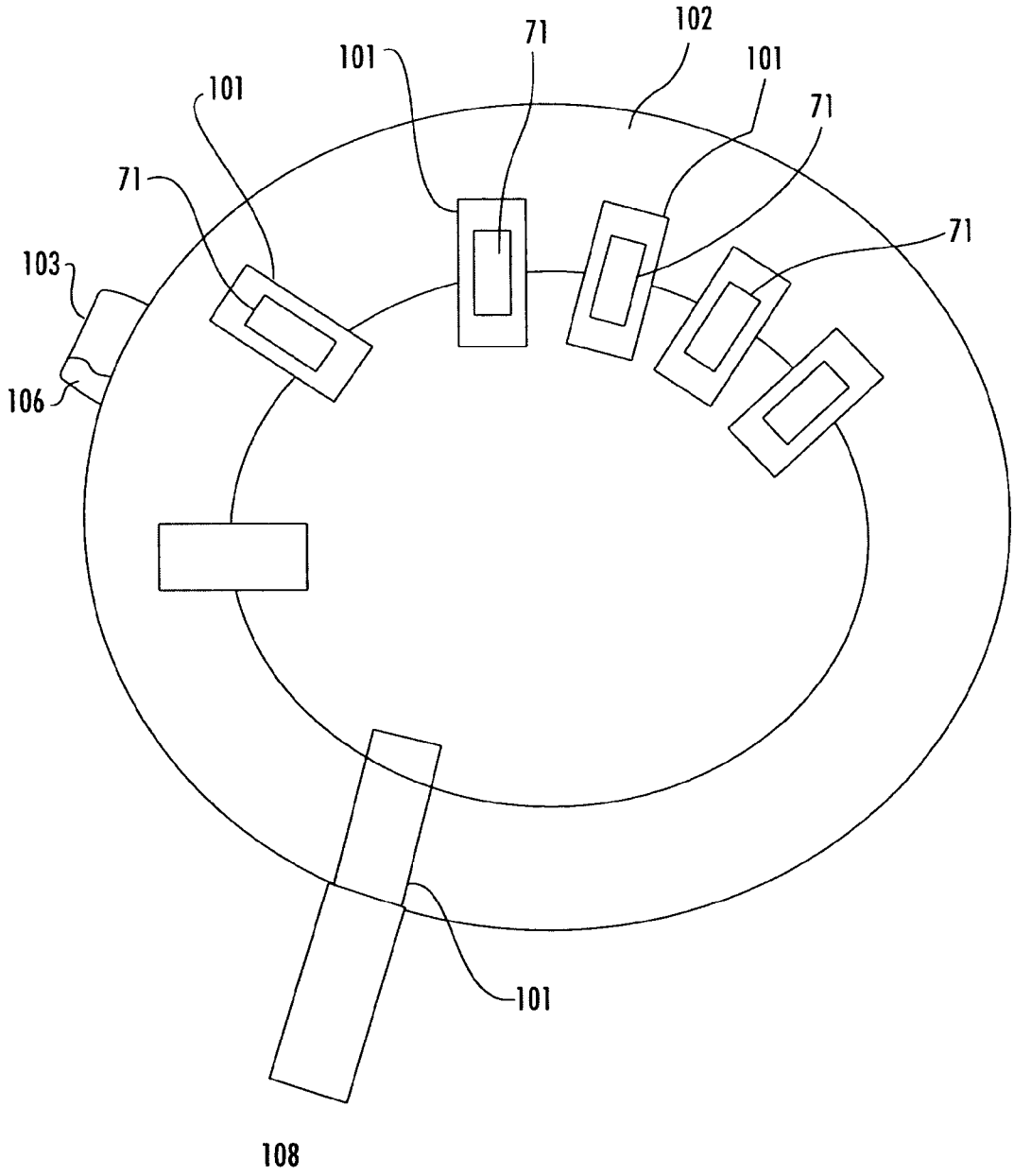
FIG. 13A is a schematic diagram of an alternate embodiment of the shuffler device.
Figure 13B:
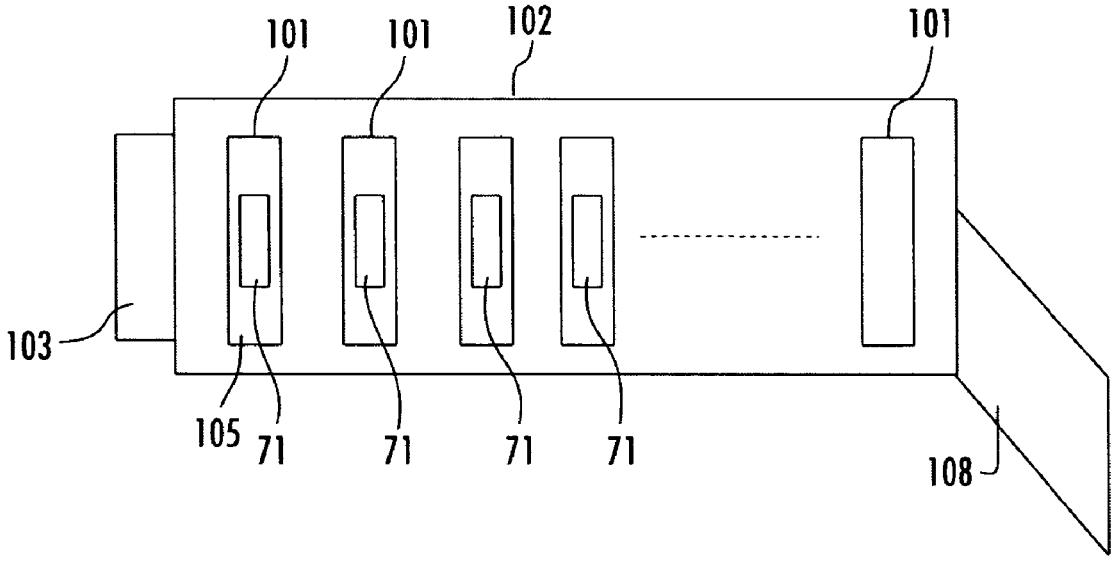
FIG. 13B is a schematic diagram of an alternate embodiment of the shuffler device.

In an alternate embodiment, shuffler device 100 includes a plurality of slots 101 in housing 102 for receiving revealer device 10, 40 or 50 or game pieces 71, as shown in FIG. 13A and FIG. 13B. Housing 102 can have a circular shape as shown in FIG. 13A or a rectangular shape as shown in FIG. 13B. Revealer device 10, 40 or 50 or game pieces 71 can be randomly placed in slots 101. Slots 102 having a similar shape as revealer device 10, 40 or 50 or game pieces 71. For example, game pieces can have a rectangular, square, round, oval shape or other polygonal shape.

In one embodiment, shuffler device 100 can include 52 slots for receiving 52 game pieces 71 relating to a conventional deck of cards. A housing can be received over game pieces 71 for protecting the game piece and providing stability of the game piece during use of shuffler device 100.

Activation means 103 can be activated to randomly remove one of revealer device 10, 40 or 50 or game pieces 71 from one of slots 101. Each of slots 101 can be numbered and activation means 103 can include processor 106 for randomly selecting one of the numbered slots. For example, activation means 103 can be a button activating a release means coupled to each of slots 101. Activation means 103 can release revealer device 10, 40 or 50 or game pieces 71 into door 105 adjacent bottom 106 of each of slots 101. Upon removal of revealer device 10, 40 or 50 or game pieces 71 from slots 101 through door 105, revealer device 10, 40 or 50 or game pieces 71 can be received in chute 108 for removal of revealer device 10, 40 or 50 or game pieces 71 from shuffler device 100.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A shuffler device comprising:

a housing;

said housing including a plurality of slots adapted for receiving one or more game pieces, said one or more game pieces being a card:

a door positioned beneath each of said slots adapted for receiving said one or more game pieces;

a chute coupled to said door, said chute adapted for receiving said one or more game pieces; and activation means for randomly removing one of said one or more game pieces from one of said slots for removal of the game piece from the shuffler device through said chute.

2. The shuffler device of claim 1 wherein the revealer device comprises:

a housing including an opaque portion for covering an inner portion of said housing, at least on marking being marked on said inner housing, said opaque portion being movable for gradually revealing said at least one marking.

3. The shuffler device of claim 2 wherein said opaque portion comprises:

a pair of movable doors, said movable doors being movable toward one another into an open position for revealing said at least one marking on one or more outer portions of said inner housing.

4. The shuffler device of claim 3 wherein upon movement of said movable doors towards one another said movable doors can be moved in a vertical direction for revealing said at least one marking on an inner portion of said inner housing.

5. The shuffler device of claim 2 wherein said at least one marking is a representative of a suit.

6. The shuffler device of claim 1 wherein the revealer device comprises:

a housing receiving or being placed over a game piece, said housing having one or more opaque portions positioned over one or more portions of said game piece, each of said opaque portions being individually rotated or slid to subsequently reveal corresponding one or more transparent portions positioned beneath said one or more opaque portions, said one or more transparent portions revealing corresponding one or more portions of said game piece.

7. The shuffler device of claim 6 wherein said opaque portion is a disc formed of an opaque material.

8. The shuffler device of claim 1 wherein the revealer device comprises:

a circular housing including a slot extending radially from an edge of said circular housing to a center of said circular housing; and a circular game piece including a slot extending radially from an edge of said circular game piece to a center of said circular game piece, said game piece including one or more values, said slot of said circular housing being placed adjacent said slot of said game piece wherein said circular housing is rotated to reveal said one or more values of said game piece.

9. A shuffler device comprising:

a housing:

said housing including a plurality of slots adapted for receiving one or more revealer devices;

activation means for randomly removing one of said one or more revealer devices from one of said slots, wherein the revealer device comprises:

a housing for receiving a game piece, said housing including an opaque portion for covering at least a portion of said game piece, said opaque portion being movable for gradually revealing at least one marking on said at least one portion of said game piece.

10. The shuffler device of claim 9 wherein said opaque portion comprises:

a pair of movable doors, said movable doors being movable toward one another into an open position for revealing said at least one marking on one or more outer portions of said game pieces.

11. The shuffler device of claim 10 wherein upon movement of said movable doors towards one another said movable doors can be moved in a vertical direction for revealing said at least one marking on an inner portion of said game piece.

12. The shuffler device of claim 9 wherein said game piece is a card and said at least one marking is a representative of a suit.

13. The shuffler device of claim 9 further comprising:

a door positioned beneath each of said slots for receiving said one or more revealer devices.

14. The shuffler device of claim 13 further comprising:

a chute coupled to said door, said chute receiving said one or more revealer devices.

* * * * *